US009682261B1

(12) United States Patent
Saito

(10) Patent No.: US 9,682,261 B1
(45) Date of Patent: Jun. 20, 2017

(54) PIERCING NOZZLE

(71) Applicant: Tristan Y. Saito, Soldotna, AK (US)

(72) Inventor: Tristan Y. Saito, Soldotna, AK (US)

( * ) Notice: Subject to any disclaimer, the term of this patent is extended or adjusted under 35 U.S.C. 154(b) by 0 days.

(21) Appl. No.: 14/706,380

(22) Filed: May 7, 2015

Related U.S. Application Data

(60) Provisional application No. 61/989,871, filed on May 7, 2014.

(51) Int. Cl.
*A62C 31/22* (2006.01)

(52) U.S. Cl.
CPC ..... *A62C 31/22* (2013.01)

(58) Field of Classification Search
CPC ..... A62C 31/22
USPC ..... 169/70
See application file for complete search history.

(56) References Cited

U.S. PATENT DOCUMENTS 674,343 A 5/1901 Oakes
2,224,010 A 8/1938 Barber
2,235,915 A * 3/1941 Bohan ..... A62C 31/22 169/70
2,548,621 A 3/1948 Rutledge
2,506,126 A * 5/1950 Williamson ..... A62C 31/22 169/5
2,756,829 A * 7/1956 Phillips ..... A62C 31/22 169/62
2,993,650 A 7/1961 Badberg
4,147,216 A 4/1979 Schnepfe, Jr. et al.
4,219,084 A 8/1980 Gray et al.
4,485,877 A 12/1984 McMillan et al.
4,779,801 A * 10/1988 O'Donnell ..... A62C 31/22 169/91
4,802,535 A 2/1989 Bakke
4,858,695 A * 8/1989 Goble ..... A62C 35/00 169/62
5,649,599 A 7/1997 Catanese, Jr.
5,839,664 A 11/1998 Relyea
5,921,323 A * 7/1999 Cronk ..... A62C 4/04 169/54
6,398,136 B1 6/2002 Smith
7,017,832 B1 3/2006 Nelson et al.
7,438,239 B2 10/2008 Woodson
7,748,469 B1 * 7/2010 Todman ..... A62C 31/02 169/70
2003/0132009 A1 7/2003 Thompson
2003/0159837 A1 8/2003 Itschner
2006/0021764 A1 2/2006 Archer et al.
2008/0099212 A1 * 5/2008 Do ..... A62C 27/00 169/24
2010/0044059 A1 2/2010 Mikota et al.
2013/0306335 A1 11/2013 Petzinger

* cited by examiner

*Primary Examiner* — Ryan Reis
(74) *Attorney, Agent, or Firm* — The Pizarro Firm

(57) ABSTRACT

A piercing nozzle may comprise a body having a first section, a second section substantially parallel the first section, and an offsetting section disposed so as to provide a distance between the first section and the second section, a piercing tip coupled to the second section, and a hose coupling coupled to the first section. An aperture may be formed in the second section, and a deflector may be pivotably coupled to the second section so as to substantially cover the aperture.

19 Claims, 3 Drawing Sheets

PIERCING NOZZLE

CROSS-REFERENCE TO RELATED APPLICATION

This application claims priority to U.S. Provisional Patent Application 61/989,871 entitled "PIERCING NOZZLE" filed May 7, 2014, which is hereby entirely incorporated herein by reference.

COPYRIGHT NOTICE

This application contains material that is subject to copyright protection. Such material may be reproduced exactly as it appears in Patent and Trademark Office patent files or records. The copyright owner otherwise reserves all rights to such material.

FIELD

The disclosed method and apparatus generally relate to a fire-fighting piercing nozzle for extinguishing combustion in a tank having an internal floating roof.

BACKGROUND

A storage tank may include an internal floating roof ("IFR"). Such tanks may be used, for example, to control vapor loss to the environment. Such tanks may be particularly useful for storing volatile products, such as fuel, susceptible to vapor loss. Vapor control may reduce product loss and environmental contamination. An IFR may rise or fall within a tank as product is added or withdrawn from the tank.

Unlike tanks having external floating roofs, a tank having an IFR also comprises a fixed roof to better protect to the IFR from the elements, including lightning strikes, snow and debris. The space between the IFR and fixed roof may collect some product vapors. In some embodiments, a tank may include circulation vents to allow natural ventilation of vapors, thus reducing vapor accumulation and risk of combustion. In other embodiments, product vapors may be released or captured through a pressure-vacuum vent or vapor recovery system.

An IFR may comprise one or more seals around its perimeter to substantially close the gap ("rim space") between the IFR and tank wall. A seal may comprise a variety of materials and forms, and may comprise a flexible portion, such as a wiper or vapor barrier made of fabric or foam to accommodate variations in rim space, tank wall irregularities, sliding friction and other tank- or product-specific requirements. The flexible portion may comprise a combustible material, such as nitrile, polyurethane or other elastomers or textiles.

The flexible portion may combust if subjected to sufficient heat, such as from a lightning strike, welding or static electricity discharge. Compared to combustion of product vapors, combustion of an IFR seal typically takes a relatively long time. Thus, although vapor reduction may reduce the chance of explosive combustion, combustion of the IFR seal itself remains a risk. However, the relatively long combustion period for IFR seals may allow for detection and combustion control before the product combusts, and preferably before the tank is rendered unusable. For example, if an IFR seal burns, the IFR may become unbalanced, thus allowing it to tip or sink and expose the product to vaporizing and combustion. Or, for large rim gaps, seal combustion may explosively ignite product vapors even if the IFR does not sink or tip.

Because an IFR is contained under a fixed roof and may be generally inaccessible to fire fighters, there exists a need for a method and apparatus useful for extinguishing an IFR seal fire.

SUMMARY

A piercing nozzle comprising: a hollow body having a first end and a second end, the body comprising: a first section; a second section substantially parallel the first section; an offsetting section coupling the first section and the second section, wherein the offsetting section offsets the second section from the first section by at least the width of a structure wall; a deflector pivotably coupled to the second section, the deflector disposed substantially over an aperture formed in the second section away from the first section so as to direct fluid flowing from the aperture in a direction substantially along or toward the second section; a piercing tip coupled to the first end of the body; and a hose coupling attached to the second end of the body.

A method of using the foregoing piercing nozzle, the method comprising urging the piercing tip through a structure wall to create a hole in the wall; urging the piercing nozzle through the hole sufficient to partially extend the offsetting section through the hole; and pivoting the piercing nozzle to a substantially vertical orientation with the piercing tip inside the structure.

DETAILED DESCRIPTION

Figure 1:
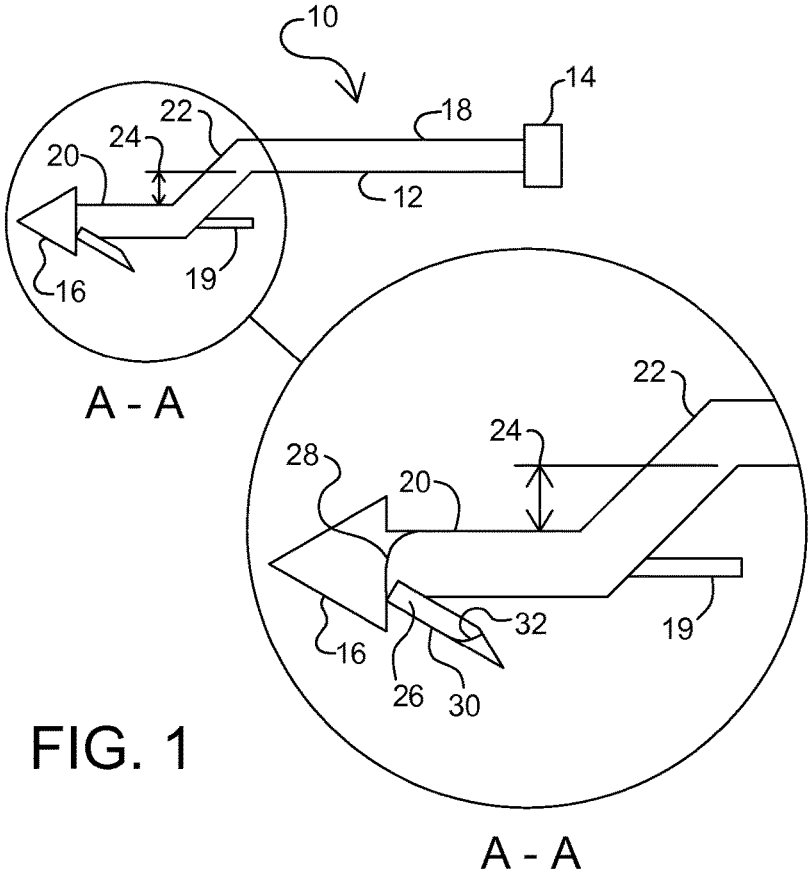
FIG. 1 illustrates one embodiment of a piercing nozzle.

As may be seen in the embodiment of FIG. 1, a piercing nozzle 10 may comprise an elongated hollow member or body 12. A hose fitting 14 may be disposed at one end of the body. A piercing tip 16 may be disposed at the other end of the body. The piercing tip may comprise any suitably hard, non-sparking material, such as brass, and may be removably attached to the body. Thus, a piercing tip may be replaced after damage, or as needed for piercing a structure. In other embodiments, the piercing tip may be integrally formed as part of the body.

The body may comprise a first section 18 and a second section 20. The first section and the second section may be substantially parallel, and may be sealingly connected with an offsetting section 22. The offsetting section may comprise a length suitable to provide an offset 24. The offset distance may be at least the width or thickness of a wall of an IFR tank or other structure. The offsetting section 22 may separate the first section 18 and second section 20 by any suitable geometry. In the embodiment of FIG. 1, the offsetting section may be disposed at a substantially 45° angle with respect to the axis of the first section 18. In other embodiments, the offsetting section may be disposed at any other suitable angle, such as at 90° to the first and second sections, or at an angle so that the first section, offsetting section and second section form a zig-zag-shaped body. The piercing nozzle may further comprise a barb 19. The body may comprise any suitable fire-resistant material, such as steel or aluminum. The body may further comprise any suitable cross-sectional geometry, such as a circle or polygon.

As may be seen in detail "A-A" of FIG. 1, the piercing nozzle may comprise an aperture 26 to allow fire-fighting fluid to flow through the body from the hose (not shown) coupled to the hose fitting 14, and out the aperture 26. The aperture may be disposed on the side of the second section 20 away from the first section 18. The piercing nozzle may comprise one or more internal baffles 28 to better direct fluid out the aperture 26. A deflector 30 may be pivotably connected to the second section 20. The deflector 20 may comprise an impact plate 32 that may deflect the fluid flow to a direction more parallel or towards the second section 20.

Figure 2:
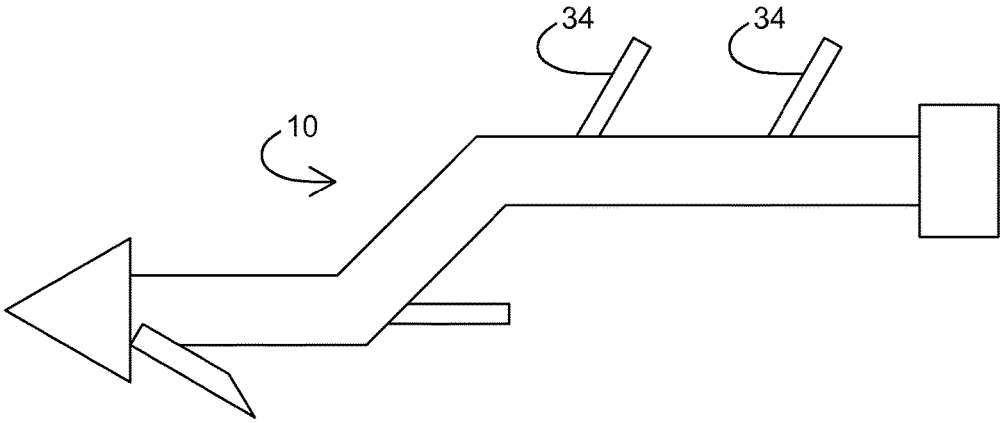
FIG. 2 illustrates one embodiment of a piercing nozzle having one or more handles.
Figure 3:
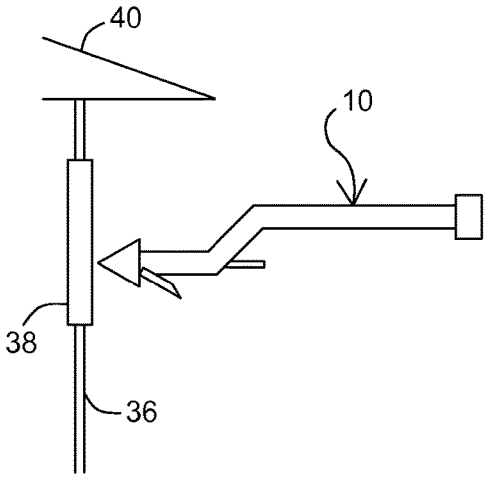
FIGS. 3-8 illustrate a method of using the piercing nozzle of FIG. 1.
Figure 4:
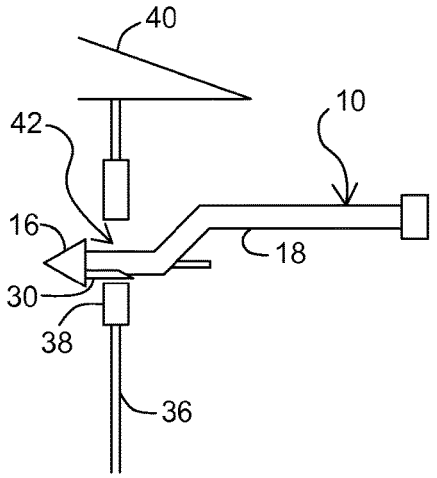

As may be seen in the embodiment of FIG. 2, the piercing nozzle 10 may be provided with one or more handles 34 suitably arranged to allow a firefighter to use the piercing nozzle in the manner of a battering ram. That is, a firefighter may grasp the handles 34 and urge the piercing nozzle toward the wall of a tank or other structure with sufficient force as to penetrate the wall or other structure, as may be seen in FIGS. 3-6.

As may be seen in FIGS. 3-6, a piercing nozzle 10 may be urged toward a tank wall 36. As may be seen in FIG. 3, the piercing nozzle may be urged toward a portion of the tank wall more susceptible to piercing, such as an eyebrow vent 38, which may be disposed just below a tank roof 40. As may be seen in FIG. 4, the piercing tip 16 may penetrate the tank wall. As the piercing tip passes through the tank wall, the tank wall may force the deflector 30 to pivot toward the piercing nozzle body 18. The deflector 30 may be configured to lie substantially against the body 18 in a closed position so as to fit through the hole 42 created by the piercing tip 16. In some embodiments, the deflector may be provided with a spring (not shown) to urge the deflector to an open position (thus substantially uncovering the aperture 26), or to a closed position (thus substantially covering the aperture 26).

Figure 5:
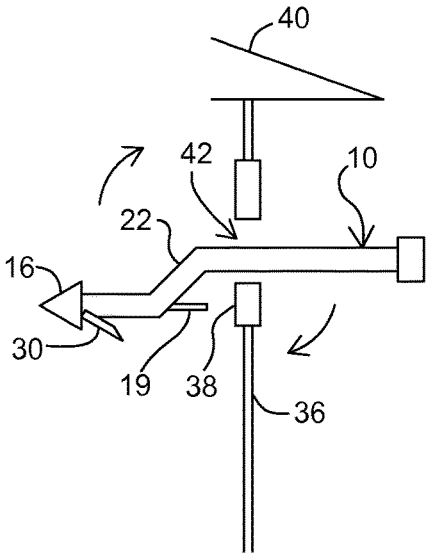
Figure 6:
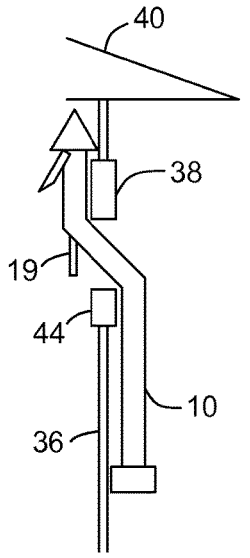

As may be seen in FIG. 5, the piercing nozzle may be partially urged through the tank wall hole 42 such that the offsetting portion 22 passes at least partly through the hole 42. If the piercing nozzle comprises a barb 19, the barb may pass through the tank wall hole 42, as well. After the piercing nozzle passes at least partway through the tank wall hole 42, the deflector 30 may open by gravity or spring force, or remain in a closed position, according to various embodiments. So disposed in the tank wall hole 42, the piercing nozzle 10 may be pivoted to point the piercing nozzle 16 in a substantially upright or vertical position, as may be seen in FIG. 6. If the piercing nozzle is equipped with a barb 19, the barb may help retain the piercing nozzle in the tank wall hole 42 by resting against the inner face 44 of the tank wall 36. So oriented, the piercing nozzle may hang in the tank wall hole 42 while firefighters retreat to a safe distance.

Figure 7:
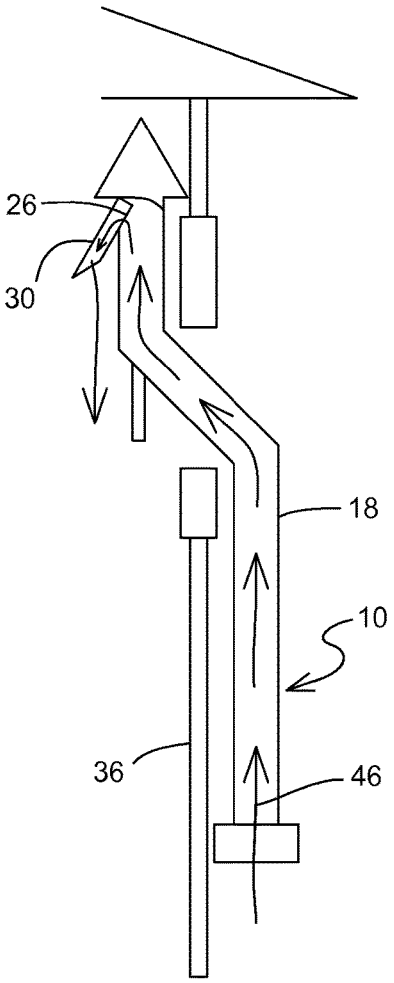
Figure 8:
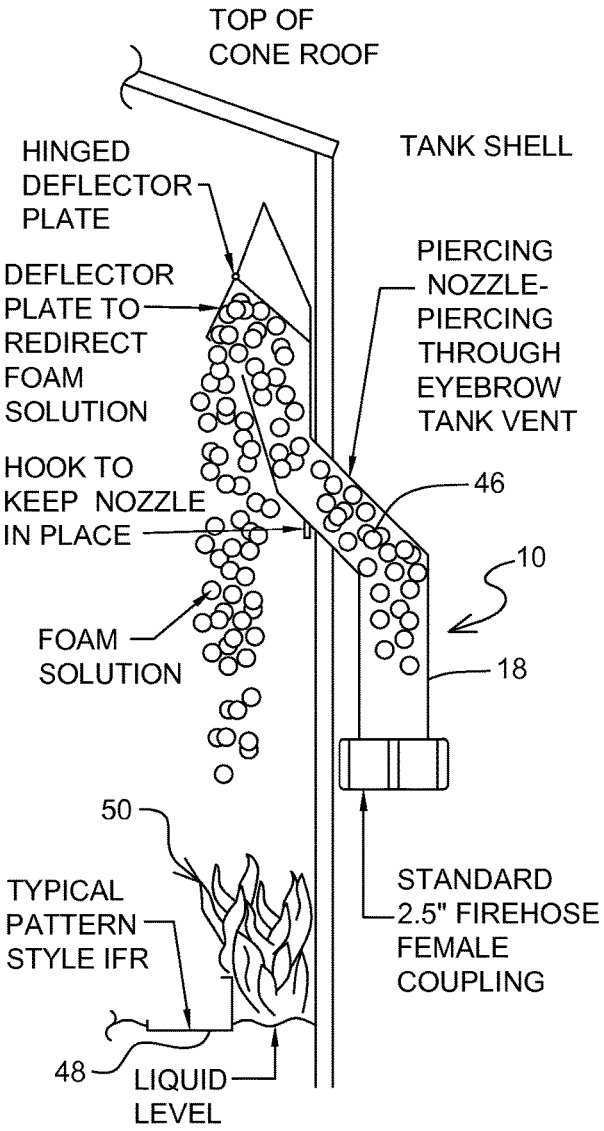

As may be seen in FIG. 7, fire-fighting fluid 46, such as foam, may travel through the piercing nozzle 10. The fluid may pass through the body 18 and out the aperture 26. In some embodiments, the fluid flow may open the deflector 30. The deflector may redirect the fluid flow generally along or toward the tank wall 36, so that the fluid may flow toward an IFR seal 48, as may be seen in the embodiment of FIG. 8. So redirected, the fluid may suppress or extinguish a fire 50 burning the IFR seal or the fluid covered by the IFR.

Depending on the size of the structure having a fire to be suppressed or extinguished, more than one such piercing nozzle may be used. For example, for an IFR tank of 250-ft diameter, four nozzles may be used, e.g., one nozzle at each quadrant. Of course, the piercing nozzle described and claimed herein may be used for a suppressing or extinguishing a fire along the inner wall of any structure. Use of such a piercing nozzle is thus not limited to IFR tanks.

Although the disclosed subject matter and its advantages have been described in detail, it should be understood that various changes, substitutions and alterations can be made herein without departing from the invention as defined by the appended claims. Moreover, the scope of the claimed subject matter is not intended to be limited to the particular embodiments of the process, machine, manufacture, composition, or matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods or steps.

I claim:

1. A piercing nozzle comprising:

an elongate hollow body configured to convey fluid, the hollow body having a first end and a second end, the hollow body comprising:

a first section;

a second section substantially parallel the first section and having an aperture formed therein;

an offsetting section coupling the first section and the second section, wherein the offsetting section offsets the second section from the first section by at least the width of a wall of a structure, the offsetting section configured to hang the hollow body from the wall in a substantially vertical orientation with the first section being disposed on one side of the wall and the second section and the aperture being disposed on the other side of the wall;

a fluid deflector swingably coupled to the second section, the fluid deflector disposed substantially over the aperture and swingable away from the aperture so as to direct fluid flowing from the aperture in a direction substantially downwardly along or toward the other side of the wall;

a piercing tip coupled to the second section at the first end of the body; and a hose coupling coupled to the first section at the second end of the body.

2. The piercing nozzle of claim 1, wherein the piercing nozzle is removably coupled to the first end of the body.

3. The piercing nozzle of claim 1, further comprising a barb attached to the offsetting section.

4. The piercing nozzle of claim 1, further comprising a handle.

5. The piercing nozzle of claim 1, further comprising an internal baffle to direct fluid flow toward the aperture.

6. The piercing nozzle of claim 1, the fluid deflector further comprising an impact plate.

7. The piercing nozzle of claim 1, further comprising a spring to urge the fluid deflector either away from or toward the aperture.

8. A method of using a piercing nozzle having a piercing tip, the method comprising:

urging the piercing tip of the piercing nozzle through a wall of a structure to create a hole in the wall, the piercing nozzle comprising:

an elongate hollow body having a first section configured for coupling to a fluid source, and a second section offset from the first section by an offsetting section and having an aperture formed therein, the piercing tip coupled to the second section, and a fluid deflector swingably disposed over the aperture; and pivoting the piercing nozzle to a substantially vertical orientation so as to hang from the wall of the structure at the offsetting section with the piercing tip and aperture inside the structure, such that the fluid deflector may direct fluid substantially downwardly along or toward the wall of the structure.

9. The method of claim 8, wherein the structure is an internal floating roof tank, and the fluid may flow downwardly toward an internal floating roof seal.

10. The method of claim 8, wherein the wall of the structure urges the fluid deflector toward the aperture when the second section passes through the hole.

11. The method of claim 10, the piercing nozzle further comprising a spring disposed so as to urge the fluid deflector to swing away from the aperture.

12. The method of claim 8, further comprising introducing pressurized fluid through the hollow body and out the aperture.

13. The method of claim 12, wherein the fluid urges the fluid deflector to swing away from the aperture.

14. A piercing nozzle comprising:

an elongate hollow body configured to convey fluid, the hollow body having a first end and a second end, the hollow body comprising:

a first section;

a second section offset from the first section and having an aperture formed therein;

an offsetting section coupling the first section and the second section, the offsetting section configured to hang the hollow body from a wall of a structure in a substantially vertical orientation with the first section being disposed on one side of the wall and the second section and the aperture being disposed on the other side of the wall;

a fluid deflector swingably coupled to the second section, the fluid deflector disposed substantially over the aperture so as to direct fluid flowing from the aperture in a direction substantially downwardly along or toward the other side of the wall;

a piercing tip coupled to the second section at the first end of the body; and a fluid-tight coupling coupled to the first section at the second end of the body.

15. The piercing nozzle of claim 9, wherein the structure is an internal floating roof tank.

16. The piercing nozzle of claim 9, wherein the piercing nozzle is formed as part of the first end of the body.

17. The piercing nozzle of claim 14, wherein the fluid-tight coupling is a fire hose coupling.

18. The piercing nozzle of claim 1, wherein the piercing nozzle is formed as part of the first end of the body.

19. The piercing nozzle of claim 1, wherein the structure is an internal floating roof tank.

* * * * *